US012404787B2

(12) United States Patent
Massey et al.

(10) Patent No.: US 12,404,787 B2
(45) Date of Patent: Sep. 2, 2025

(54) HYDRAULIC VALVE ACTUATION SYSTEM WITH CONTROLLED VALVE SEATING VELOCITY AND METHOD THEREFOR

(71) Applicant: ARA4 Consulting LLC, Warwick, NY (US)

(72) Inventors: Steven E Massey, Woodland Park, CO (US); Tibor Kiss, Manitou Springs, CO (US)

(73) Assignee: ARA4 Consulting LLC, 25 Railroad Avenue, Warwick, NY (US)

( * ) Notice: Subject to any disclaimer, the term of this patent is extended or adjusted under 35 U.S.C. 154(b) by 0 days.

(21) Appl. No.: 18/432,226

(22) Filed: Feb. 5, 2024

(65) Prior Publication Data

US 2024/0263573 A1 Aug. 8, 2024

Related U.S. Application Data

(60) Provisional application No. 63/483,281, filed on Feb. 4, 2023.

(51) Int. Cl.

| | |
|---|---|
| ***F01L 9/10*** | (2021.01) |
| ***F01L 9/40*** | (2021.01) |
| *F01L 1/26* | (2006.01) |

(52) U.S. Cl.

CPC ..... *F01L 9/10* (2021.01); *F01L 9/40* (2021.01); *F01L 1/26* (2013.01); *F01L 2009/4086* (2021.01)

(58) Field of Classification Search

CPC ..... F01L 1/26; F01L 9/10; F01L 9/40; F01L 2009/4086

(Continued)

(56) References Cited

U.S. PATENT DOCUMENTS 6,374,784 B1 * 4/2002 Tischer ..... F01L 1/143 123/90.11
6,675,751 B1 * 1/2004 Megli ..... F01L 9/20 123/90.49

(Continued)

FOREIGN PATENT DOCUMENTS

CN 101111665 A * 1/2008 ..... F01L 9/02
EP 0830496 B1 3/2003

OTHER PUBLICATIONS

International Search Report and Written Opinion of the International Searching Authority, dated May 28, 2024, of counterpart PCT application PCT/US2024/014408, with international filing date Feb. 2, 2024.

*Primary Examiner* — Jorge L Leon, Jr.
(74) *Attorney, Agent, or Firm* — Gillis Patent Law, LLC

(57) ABSTRACT

A hydraulic valve actuation system with controlled valve seating velocity and method therefor are proposed. The system includes an actuator with a housing and a drive assembly formed from a drive piston within the housing and an adjustment pin. In an internal combustion engine application, the adjustment pin contacts and moves an engine valve that controls air and fuel entering an engine cylinder. The actuator provides velocity dampening of the drive piston, via an annulus-shaped fluid communication path defined by at least one surface of the drive piston and at least one opposing surface of a damping chamber formed within the housing. The dampening hydraulically cushions the impact of a bottom of the drive piston against a bottom stop of the actuator during opening of the engine valve, which reduces noise and engine wear. In another example, the system is configured to control an engine valve seating velocity.

20 Claims, 9 Drawing Sheets

(58) Field of Classification Search
USPC ..... 123/90.12
See application file for complete search history.

(56) References Cited

U.S. PATENT DOCUMENTS

| | | | | |
|---|---|---|---|---|
| 7,182,068 | B1 | 2/2007 | Sturman et al. | |
| 7,341,028 | B2 | 3/2008 | Klose et al. | |
| 7,730,858 | B2 | 6/2010 | Babbitt et al. | |
| 2004/0055547 | A1 | 3/2004 | Diehl et al. | |
| 2006/0081213 | A1* | 4/2006 | Yang ..... | F01L 13/0031 123/90.22 |
| 2006/0112918 | A1* | 6/2006 | Persson ..... | F01L 1/26 123/90.27 |
| 2007/0079780 | A1 | 4/2007 | Ling et al. | |
| 2008/0236525 | A1 | 10/2008 | Babbitt et al. | |

* cited by examiner

HYDRAULIC VALVE ACTUATION SYSTEM WITH CONTROLLED VALVE SEATING VELOCITY AND METHOD THEREFOR

RELATED APPLICATIONS

This application claims the benefit under 35 USC 119(e) of U.S. Provisional Application No. 63/483,281 filed on Feb. 4, 2023, which is incorporated herein by reference in its entirety.

BACKGROUND OF THE INVENTION

Traditionally, intake and exhaust air valves of a reciprocating internal combustion engine ("ICE") are operated by a camshaft, which itself is driven by an engine crankshaft. The camshaft typically includes or is formed to provide a separate cam for each engine valve, where the rotation of the camshaft causes each cam to open and close its respective engine valve repeatably over each engine cycle. The engine crankshaft, camshaft and its cams form a valve actuation system.

These existing valve actuation systems have limitations. The systems are rigid, and typically cannot be adjusted to provide optimal timing settings of the valves when engine operating conditions (e.g. speed, load) are changed. This is because the timing of each engine valve opening and closing is set/defined by the cam geometry. Mechanical add-on systems supported by and including electronic controls can be applied to the valve actuation systems to monitor and adjust operation and timing of the valves, but the add-on systems are complicated and expensive.

For full control of the timing of the intake and exhaust valves, hydraulically operated valve actuation systems ("HVA systems") have been extensively researched in the past. An exemplary HVA system is disclosed in U.S. Pat. No. 12,135,414, issued Jun. 8, 2010. These existing HVA systems are electronically controlled and are designed to replace the camshaft and cams of the existing valve actuation systems. While various HVA systems systems have been proposed, challenges still remain to make these existing systems commercially viable. The present invention addresses challenges regarding the robustness, durability and quiet operation of the existing HVA systems.

SUMMARY OF THE INVENTION

When an existing HVA system is configured for use in an ICE, in one example, a hydraulic actuator ("actuator") of the HVA system has an actuation cycle defined by a closed position of the actuator that may correspond to/may be timed with a beginning of the engine cycle, and an open position that may correspond to/may be timed with a middle of the engine cycle.

When used in an ICE, the actuator controls opening and closing of an engine valve. For this purpose, the actuator includes a drive piston that is in contact with an external adjustment pin. The adjustment pin, in turn, connects to the engine valve (or to a bridge, which in turn connects to the engine valve and a second engine valve). Because the actuator provides opening and closing of the engine valve, the open position of the actuator conicides with an open position of the engine valve, and the closed position of the actuator coincides with a closed position of the engine valve. Thus, when the HVA system is used in an ICE, the actuation cycle of the actuator is also known as a valve actuation cycle and may be timed with the engine cycle.

When the ICE is in the middle of its engine cycle (i.e., when the engine valve is fully open/is in its open position to let a mixture of air and fuel to enter an engine cylinder), the actuator is fully open/is in its open position, which also causes the engine valve to be fully open/in its open position. At this time, the drive piston within the actuator is at its lowest position within the actuator, where a bottom surface of the drive piston impacts an inside surface of a bottom stop of the actuator.

A proposed HVA system provides improvements over the existing valve actuation systems, including the existing HVA systems. In one example, each actuator of the proposed HVA system is configured to provide velocity dampening of its drive piston within the actuator when the engine valve is in the middle of its engine cycle. The velocity dampening cushions the impact of the drive piston against the bottom stop, which reduces noise and reduces engine wear. In another example, from the middle of the engine cycle back to a beginning of the cycle, the actuator is configured to control an engine valve seating velocity. In yet another example, the actuator provides velocity dampening of the drive piston within the actuator, as the drive piston nears an inside surface of a top stop of the actuator. When the engine valve is closed/in its closed position, the actuator is in its closed position, and the engine has returned to the beginning of its (next) engine cycle.

For this purpose, in an embodiment, the drive piston and a housing geometry of the actuator are deisgned to collectively form a hydraulic damper squeeze pocket and a fluid communication orifice/path in the shape of a ring or annulus as the drive piston approaches at least one of its extreme positions/stops. This annulus-shaped fluid communication path is also known as an annulus. The annulus is located between and defined or otherwise formed by at least one surface of the drive piston, and at least one surface of the actuator housing that opposes the at least one surface of the drive piston. A flow area of the formed annulus is a function of a distance between a surface of the drive piston that defines the flow area, to an inside surface of a hard stop within the actuator that defines the extreme position.

As a result, the proposed HVA system provides low impact velocities for the drive piston within the actuator and for the engine valve on their respective stops, which provides a preferable trajectory of these moving parts as they approach their hard stops.

The proposed HVA system also provides the ability to retrofit existing and new heavy duty industrial ICEs to improve the overall efficiency of the new engines. The proposed system also reduces fuel consumption and carbon output, and is fuel agnostic.

In general, according to one aspect, the invention features a hydraulic actuator. The actuator includes a housing and a drive piston. The housing forms an actuating chamber and a damping chamber within the housing, where the actuating chamber is bounded by the housing and an inside surface of a top stop located at a proximal end of the housing. The damping chamber is bounded by the housing and an inside surface of a bottom stop, where the bottom stop is located at a distal end of the housing that opposes the proximal end.

The drive piston includes a top section and a damping section. The top section is configured to travel within the actuating chamber along a central travel axis that extends from the proximal end to the distal end, and the damping section is configured to travel within the damping chamber along the travel axis. Preferably, at least one surface of the damping section and at least one corresponding surface of the damping chamber are configured to form an annulus-shaped fluid communication path ("annulus") therebetween that varies in area based upon a location of the damping section relative to the damping chamber, to controllably dampen a velocity of the drive piston during each actuation cycle of the actuator.

In one implementation, the at least one surface of the damping section and the at least one surface of the damping chamber are configured to decrease the area of the annulus as the damping section moves distally towards the inside surface of the bottom stop to dampen the velocity of the drive piston. When a bottom surface of the damping section impacts the inside surface of the bottom stop, in one example, the velocity of the drive piston is less than or equal to two tenths of a meter per second.

The actuator also includes an adjustment pin with a top surface configured to be in unattached contact with a bottom surface of the damping section and to remain so over each actuation cycle of the actuator. For this purpose, in an embodiment, a bottom surface of the adjustment pin that opposes its top surface attaches to and controls opening and closing of an engine valve. In another embodiment, a bottom surface of the adjustment pin interfaces with a bridge, where the bridge controls opening and closing of at least two engine valves.

In another implementation, the at least one surface of the damping section and the at least one surface of the damping chamber are configured to decrease the area of the annulus as the damping section moves proximally toward and nears the inside surface of the top stop, the decrease in area of the annulus decreasing the velocity of the drive piston. Typically, the damping section is substantially disk-shaped, where a shape of the at least one surface of the damping section is a combination of cylindrical and conical shapes. The at least one surface of the damping chamber is also typically cylindrical in shape.

In general, according to another aspect, the invention features a method of operation of a hydraulic actuator. The actuator includes a housing forming an actuating chamber and a damping chamber within the housing, the actuating chamber being bounded by the housing and an inside surface of a top stop of the actuator, and the damping chamber being bounded by the housing and an inside surface of a bottom stop of the actuator, the top stop being located at a proximal end and the bottom stop being located at a distal end that opposes the proximal end. The method of operation comprises: receiving hydraulic fluid under pressure within the actuating chamber and the damping chamber, the hydraulic fluid driving a drive piston of the actuator, the drive piston including a top section and a damping section, the driving causing the top section to travel in a distal direction within the actuating chamber along a central travel axis that extends from the proximal end to the distal end, and causing the damping section to travel in the distal direction within the damping chamber along the travel axis; and at least one surface of the damping section and at least one corresponding surface of the damping chamber forming an annulus-shaped fluid communication path ("annulus") therebetween, the annulus varying in area based upon a location of the damping section relative to the damping chamber, the varying in area of the annulus controllably dampening a velocity of the drive piston during each actuation cycle of the actuator.

The method further comprises decreasing the area of the annulus as the damping section moves distally towards the bottom stop, the decrease in area of the annulus dampening the velocity of the drive piston. In one implementation, the method further comprises the velocity of the drive piston being less than or equal to two tenths of a meter per second, upon a bottom surface of the damping section impacting the inside surface of the bottom stop. Preferably, a top surface of an adjustment pin is in unattached contact with a bottom surface of the damping section and remains so over each actuation cycle of the actuator.

In an embodiment, the method further comprises attaching a bottom surface of the adjustment pin that opposes its top surface to an engine valve, the adjustment pin controlling opening and closing of the engine valve. Additionally and/or alternatively, the method further comprises attaching a bridge to a bottom surface of the adjustment pin that opposes its top surface, the bridge controlling opening and closing of at least two engine valves. The method might also further comprise decreasing the area of the annulus as the damping section moves proximally toward and nears the inside surface of the top stop, the decrease in area of the annulus decreasing the velocity of the drive piston.

In general, according to yet another aspect, the invention features a hydraulic valve actuation system ("HVA system"). The HVA system includes an actuator, an adjustment pin and at least one engine valve. The actuator includes a housing that forms a damping chamber within the housing, where the damping chamber is bounded by the housing and an inside surface of a bottom stop located at a distal end of the actuator. The actuator also includes a drive piston including a damping section configured to travel within the damping chamber along a central travel axis.

The damping section is configured to receive hydraulic fluid under pressure. For this purpose, at least one surface of the damping section and at least one surface of the damping chamber are configured to form an annulus-shaped fluid communication path ("annulus") therebetween. The annulus varies in area based upon a location of the damping section within the damping chamber, to controllably dampen a velocity of the damping section at different locations within the damping chamber during each actuation cycle of the actuator.

The adjustment pin has a top surface configured to be in unattached contact with a bottom surface of the damping section, and the at least one engine valve is controlled by movement of the adjustment pin.

The HVA system might also include a bridge and a second engine valve. Here, a top of the bridge is attached to a bottom surface of the adjustment pin that opposes its top surface, and the engine valve and the second engine valve are attached to a bottom of the bridge that opposes its top. The bridge is preferably configured to control operation of the engine valve and the second engine valve in response to the movement of the adjustment pin.

In the HVA system, in one implementation, the damping section is substantially disk-shaped, and a shape of the at least one surface of the damping section is a combination of cylindrical and conical shapes. In another implementation, the at least one surface of the damping chamber is cylindrical in shape.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

It will be understood that although terms such as "first" and "second" are used herein to describe various elements, these elements should not be limited by these terms. These terms are only used to distinguish one element from another element. Thus, an element discussed below could be termed a second element, and similarly, a second element may be termed a first element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
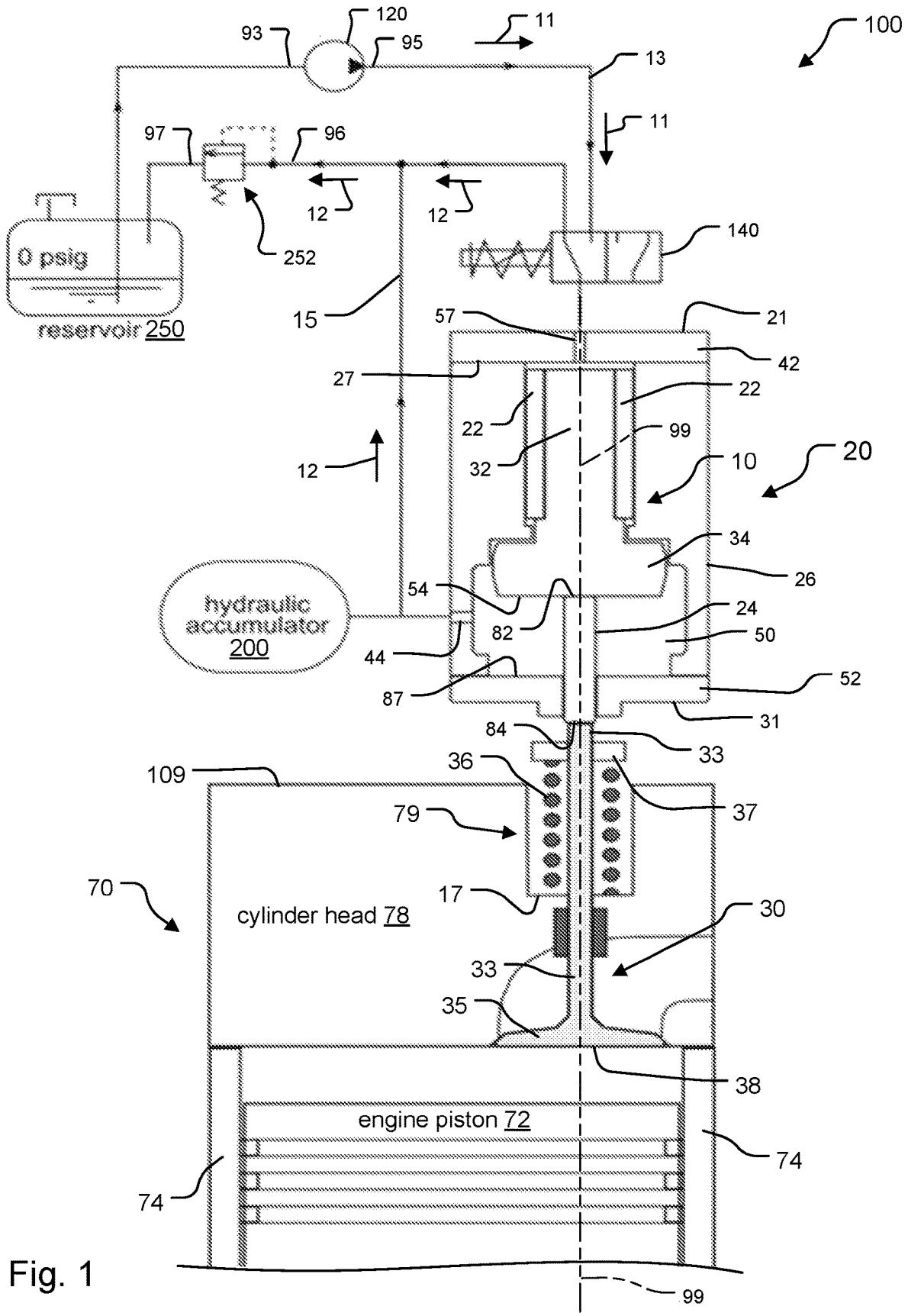
FIG. 1 is a schematic diagram that shows the main components and a general layout of an HVA system of an ICE constructed in accordance with principles of the present invention, according to an embodiment, where only one engine valve and one actuator of the HVA system are shown.

FIG. 1 shows components and a general layout of an HVA system 100, according to an embodiment. In the illustrated example, the HVA system 100 is configured for operation with an ICE 70 and includes one or more hydraulic control valves 140, an actuator 20, a pressure regulator and relief valve 252, a hydraulic pump 120, a reservoir 250, a hydraulic accumulator 200, an adjustment pin 24 and an engine valve 30.

In the illustrated example, only a portion of the ICE 70 in connection with the engine valve 30 is shown. The actuator 20, ICE 70, adjustment pin 24 and engine valve 30 are shown in cross section without cross-hatching to show more detail for components therein. While a separate actuator 20 is typically employed to control operation of each engine valve 30, only one actuator 20/engine valve 30 pair is shown. In a similar vein, while a separate hydraulic control valve 140 is typically employed to control operation of each actuator 20, only one control valve 140 is shown.

More detail for the components of the HVA system 100 is as follows. The reservoir 250 stores fluid (e.g., hydraulic or engine oil) under low pressure, typically at 0 pounds per square gauge (psig). The hydraulic pump 120 has an input side 93 and an output side 95, and the pressure regulator and relief valve 252 has an input side 96 and an output side 97.

The ICE 70 includes a cylinder head 78 and an engine cylinder 74 located below the cylinder head 78. The engine cylinder 74 includes an engine piston 72 that travels within the engine cylinder 74. A valve seat 38 is located between the cylinder head 78 and the engine cylinder 74 and provides an opening into the engine cylinder 74. At a top 109 of the cylinder head 78, a valve pocket 79 is formed within the cylinder head and has a pocket floor 17.

The actuator 20 includes various components. These components include a housing 26 that forms a damping chamber 50 and an actuating chamber (not visible) within the housing 26, a top stop 42, a bottom stop 52, a drive piston 10 and a boost piston 22. The top stop 42 has an inside surface 27 and is located at a proximal end 21 of the actuator 20. The bottom stop 52 has an inside surface 87 and is located at a distal end 31 of the actuator 20 that opposes the proximal end 21. The actuator 20 also includes a vent port 44 that connects to the damping chamber 50 and extends through a side of the housing 26, and includes a bidirectional fluid port 57 incorporated within the top stop 42. The drive piston 10 includes a top section 32 and a damping section 34.

The engine valve 30 includes a stem 33 and a head 35 connected to the stem 33. A collar 37 affixed to the valve stem 33 and a valve spring 36 are also shown.

The housing 26 of the actuator 20, the adjustment pin 24, the boost piston 22 and the drive piston 10 are typically each formed from a unitary piece of metal or hardened metal alloy material such as stainless steel. However, aluminum alloys can also be used. The actuator 20 is substantially cylindrical in shape.

The drive piston 10 and the boost piston 22 are actuating pistons that operate together to move the engine valve 30 downward/in a distal direction, via the adjustment pin 24. The boost piston 22 has a much shorter stroke than the drive piston 10, and the boost piston 22 accelerates the entry of the engine valve 30 into the engine cylinder 74 with a relatively low amount of additional high pressure hydraulic fluid.

The HVA system 100 is generally arranged as follows. With respect to hydraulic-related connections in the HVA system, the reservoir 250 stores fluid (e.g., hydraulic or engine oil) and connects to the input side 93 of the hydraulic pump 120 and the output side 97 of the pressure regulator and relief valve 252. The output side 95 of the pump 120 connects to and provides hydraulic fluid under pressure to the hydraulic control valve 140. This connection is also known as a pressurized path 13.

The hydraulic control valve 140 is an electromechanical switch that has separate connections to the input side 96 of the pressure regulator and relief valve 252, to the pump 120 and to the fluid port 57 of the actuator 20. The connection to the pressure regulator and relief valve 252 is along the low pressure return path 15, while the connection to the pump 120 is along the pressurized path 13. The hydraulic control valve 140 is under computer control and switchedly connects the pump 120 or the pressure regulator and relief valve 252 to the fluid port 57.

The hydraulic accumulator 200 connects to the low pressure return path 15 and provides pressure to the pressure regulator and relief valve 252 via its input side 96, and the vent port 44 connects to and vents to the low pressure return path 15.

A top surface 82 of the adjustment pin 24 is designed to be in unattached contact with the drive piston 10 throughout each engine cycle/actuator cycle. In more detail, a top surface 82 of the adjustment pin 24 is in contact with the bottom surface 54 of the damping section 34. A bottom surface 84 of the adjustment pin 24 that opposes its top surface 82 is attached to a top of the stem 33 of the engine valve 30. The valve spring 36 seats within the valve pocket 79 and rests upon the pocket floor 17, and is disposed between the collar 37 and the pocket floor 17.

A central travel axis 99 passes through the actuator 20 from its proximal end 21 to its proximal end 31. The travel axis 99 also passes centrally through the fluid port 57, the drive piston 10, the actuating chamber 60, the damping chamber 50, the adjustment pin 24 and the engine valve 30.

The head 35 of the engine valve 30 seats within the valve seat 38 when the engine is at the beginning of its engine cycle (as shown). The valve seat 38 has an opening (not shown, it is covered by the head 35 in the figure) that opens into the engine cylinder 74.

The HVA system 100 generally operates as follows. Here, the actuator cycle of the actuators 20 is timed to correspond to the engine cycle of the ICE 70. Each hydraulic control valve 140 is electronically controlled and uses hydraulic fluid, which is stored in the reservoir 250 typically at or slightly above ambient pressure. In one example, the hydraulic fluid is separate from engine lube oil of the ICE 70. In another example, the engine lube oil also functions as the hydraulic fluid.

At its input side 93, the pump 120 draws hydraulic fluid from the reservoir 250 and pressurizes the fluid in a range typically between 1000 and 4000 psig. A pressurized flow of hydraulic fluid from the pump 120 to the hydraulic control valve 140 and to the actuator 20, over the pressurized path 13, is indicated by arrows with reference number 11.

Each actuator 20 is in a normally closed position, where its drive piston 10 is located at a topmost position within the housing 26. The hydraulic control valve 140, when activated/turned on, connects to the pressurized path 13. This enables the pressurized flow 11 of hydraulic fluid to enter the fluid port 57 of the actuator 20. This pressurized fluid exerts a downward force/a force in a distal direction upon the drive piston 10, which in turn causes the drive piston 10 to move downward within the chambers of the housing 26. The adjustment pin 24 moves downward in response, the result of which moves the engine valve 30 downward. The adjustment pin 24 is designed to accurately position the drive piston 10 when the engine valve 30 is seated within the valve seat 38 of the engine cylinder 74.

When the engine reaches a middle of its cycle, the damping section 34 of the drive piston 10 is located at its most extreme downward position within the damping chamber 50, and the engine valve 30 is in an open position within the engine cylinder 74.

When the hydraulic control valve 140 is deactivated/turned off, the engine 70 has just begun to move from the middle of its cycle back to the beginning of its engine cycle, and the drive piston 10 is no longer under pressure. As a result, hydraulic fluid can flow back from the actuator 20 out the fluid port 57 and through the hydraulic control valve 140 into the reservoir 250, along the return path 15. This return flow of the hydraulic fluid is indicated by an arrow with reference 12. A relatively low pressure of about 40-60 psig is maintained in the return path 15 via the pressure regulator and relief valve 252 and the hydraulic accumulator 200 to help reduce pressure spikes in the HVA system 100.

Also when the hydraulic control valve 140 is turned off, because the actuator 20 is no longer under pressure, the actuator 20 requires an external force to move the drive piston 10 and the engine valve 30 back to their original/closed positions. In an ICE 70, the force that returns the drive piston 10 and the engine valve 30 back to their original/closed positions, and helps pump spent hydraulic actuation fluid from the actuator 20 into the return path 15, is provided by the valve spring 36. Any leakages from the actuator 20 are collected and returned back into the return path 15 via the hydraulic accumulator 200.

As a result, the on/off switch timing of the hydraulic control valves 140 allows the opening and closing time of the intake/exhaust valves 30 to be optimal. This timing is provided by an electronic control unit (ECU) of the HVA system 100 (not shown), which connects to each of the hydraulic control valves 140. The timing is specified by a computer program (e.g., software or firmware) that executes on a processor of the ECU.

It can also be appreciated that dynamic seals, check valves, or secondary solenoid valves are not required in the HVA system 100. Because the HVA system 100 has fewer moving parts than that of existing valve actuation systems, experimentation has shown improved cycle to cycle consistency across engine cycles of ICEs 70 that incorporate the HVA system 100, as compared to ICEs with existing valve actuation systems.

Figure 2:
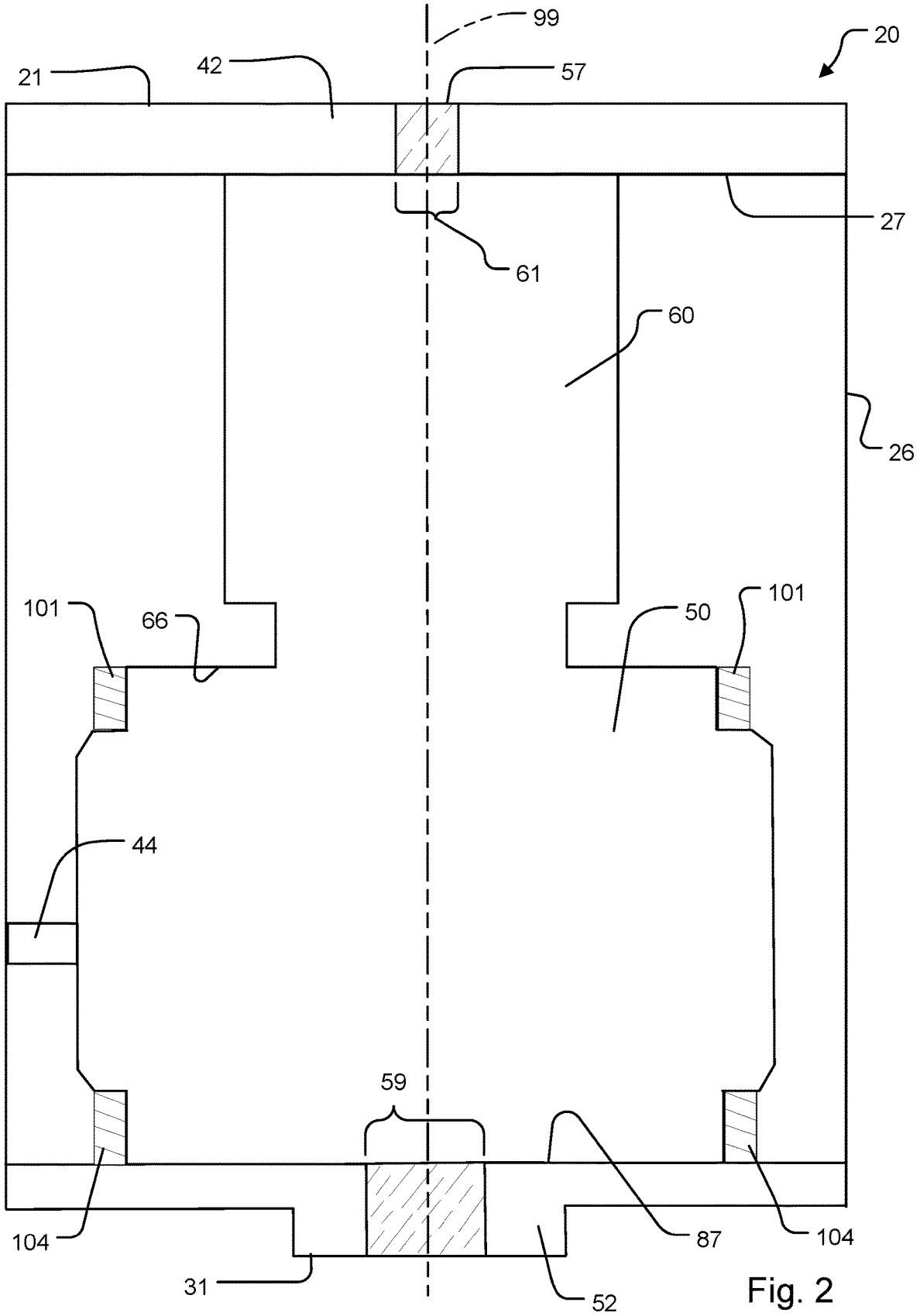
FIG. 2 is a cutaway view showing more detail for chambers formed within a housing of the actuator in FIG. 1.

FIG. 2 shows more detail for an actuating chamber 60 and the damping chamber 50 formed within the housing 26 of the actuator 20. In the figure, the actuator 20 is shown in cross-section with its drive piston 10 and boost piston 22 removed.

The actuating chamber 60 is centrally aligned within the housing 26, along the travel axis 99. The actuating chamber 60 is bounded by the housing 26 and the inside surface 27 of the top stop 42. A bore 61 within the top stop 42 allows the input port 57 to seat within the top stop 42 and to extend into the actuating chamber 60. The actuating chamber 60 is located above and extends distally into/connects to the damping chamber 50.

The damping chamber 50 has a top inside surface 66 and is also centrally aligned within the housing 26, along the travel axis 99. The damping chamber 50 is bounded by the housing 26 and the inside surface 87 of the bottom stop 52. A bore 59 within the bottom stop 52 allows the adjustment pin 24 (not shown) to enter/extend into the damping chamber 50, and to exit from the damping chamber 50. The adjustment pin 24 is designed to tightly fit into the bore 59 to minimize fluid leakages from the damping chamber 50.

The damping chamber 50 has an upper chamber surface 101 and a lower chamber surface 104 formed within. These surfaces 101, 104 are generally cylindrical in shape. The upper chamber surface 101 is located below and adjacent to the top inside surface 66 of the damping chamber 50. The lower chamber surface 104 is located above and adjacent to the inside surface 87 of the bottom stop 52. While only a portion of the upper and lower chamber surfaces 101, 104 are shown, these surfaces are provided around the entirety of the damping chamber 50.

During operation of the actuator 20, the upper chamber surface 101 is designed to oppose an upper damping surface of the drive piston 10, and the lower chamber surface 104 is designed to oppose a lower damping surface of the drive piston 10. The upper chamber surface 101 and its corresponding upper damping surface of the drive piston 10, and the lower chamber surface 104 and its corresponding lower damping surface of the drive piston 10, enable controlled deceleration of the drive piston 10 as a function of the location of the drive piston 10 relative to the damping chamber 50. More details regarding these surfaces are provided in the descriptions of FIGS. 3, 4, 5A-5C and 6A-6C, included hereinbelow.

Figure 3:
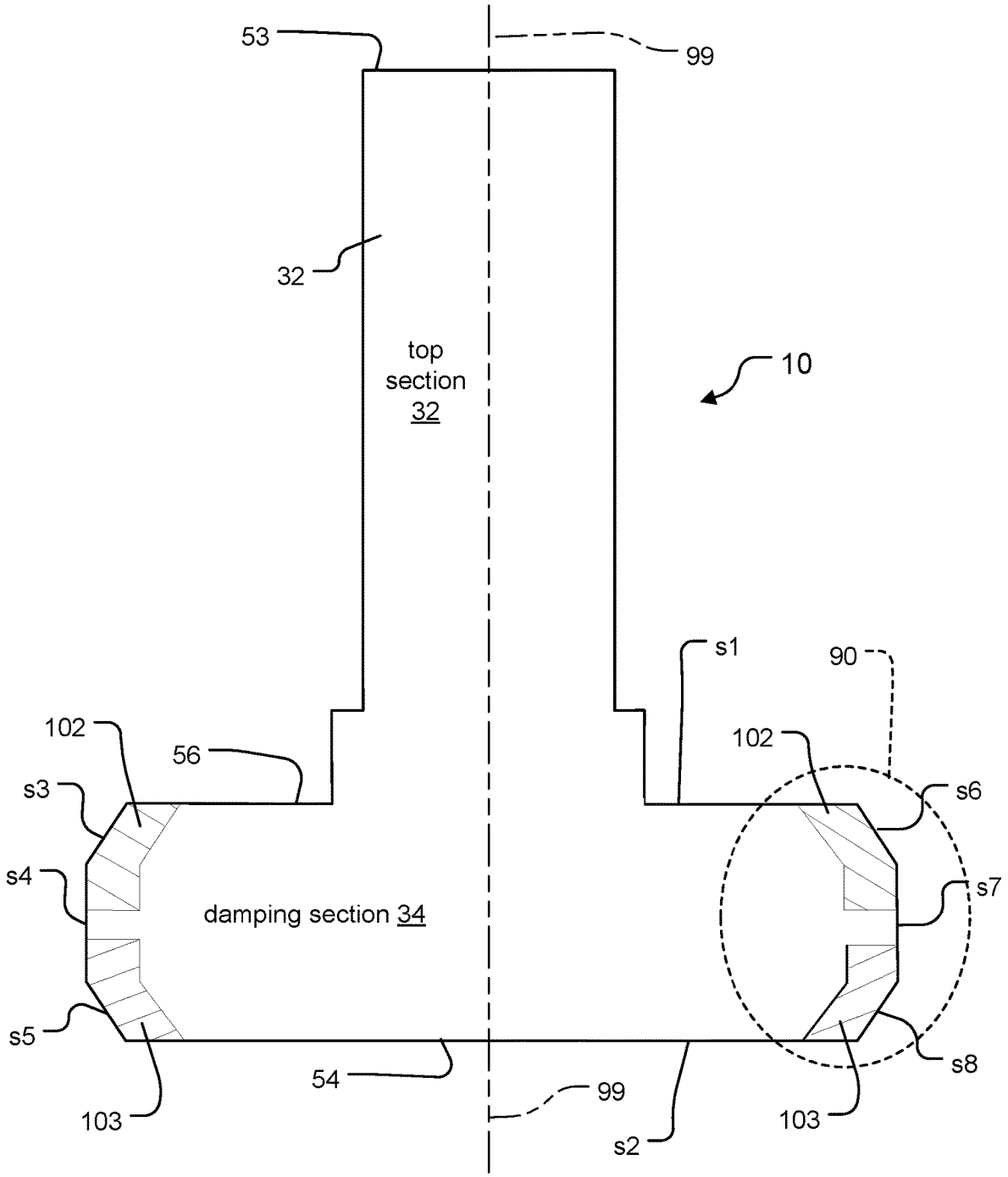
FIG. 3 is a cutaway view of a drive piston of the actuator in the HVA system of FIG. 1.

FIG. 3 is a cutaway view of the drive piston 10, shown in vertical cross-section, according to an embodiment. Here, the cross-section of the drive piston 10 resembles an upside-down letter "T".

The top section 32 is substantially cylindrical in shape, while the damping section 34 is wider than the top section and is substantially disk-shaped. The damping section 34 has a much larger diameter than the top section 32, and is designed to dampen motion of the actuator 20 and engine valve 30 as they approach their extreme positions during each engine cycle.

Because the damping section 34 is substantially disk-shaped, when viewed in cross-section as shown, it is substantially octagonal in shape with eight sides s1 through s8. A top side s1 and a bottom side s2 oppose one another, are substantially horizontal and parallel to one another and have substantially the same length. Opposing sides s4 and s7 of the damping section 34 are substantially vertical and parallel to one another and have substantially the same length. Side s3 tapers inward towards top side s1, and side s6 tapers inward toward top side s1. In a similar vein, side s5 tapers inward towards bottom side s2, and side s8 tapers inward toward bottom side s2. The sides s3, s4 and s5 (or the sides s6, s7 and s8) collectively form a "shoulder" 90 of the damping section 34.

An upper damping surface 102 and a lower damping surface 103 of the damping section 34 of the drive piston 10 are shown. The upper damping surface 102 is located below and is adjacent to a top 56 of the damping section 34. The lower damping surface 103 is located above and is adjacent to the bottom surface 54 of the damping section 34. While only a portion of the upper and lower damping surfaces 102, 103 are shown, these surfaces are provided around the entirety of the damping section 34.

In one example, the upper and lower damping surfaces 102, 103 are a combination of cylindrical and conical surfaces. In other examples, the upper and lower damping surfaces 102, 103 might be radii or curves. As noted in the description of FIG. 2, the upper damping surface 102 is designed to oppose the upper chamber surface 101 of the damping chamber 50, while the lower damping surface 103 is designed to oppose the lower chamber surface 104 of the damping chamber 50.

Figure 4:
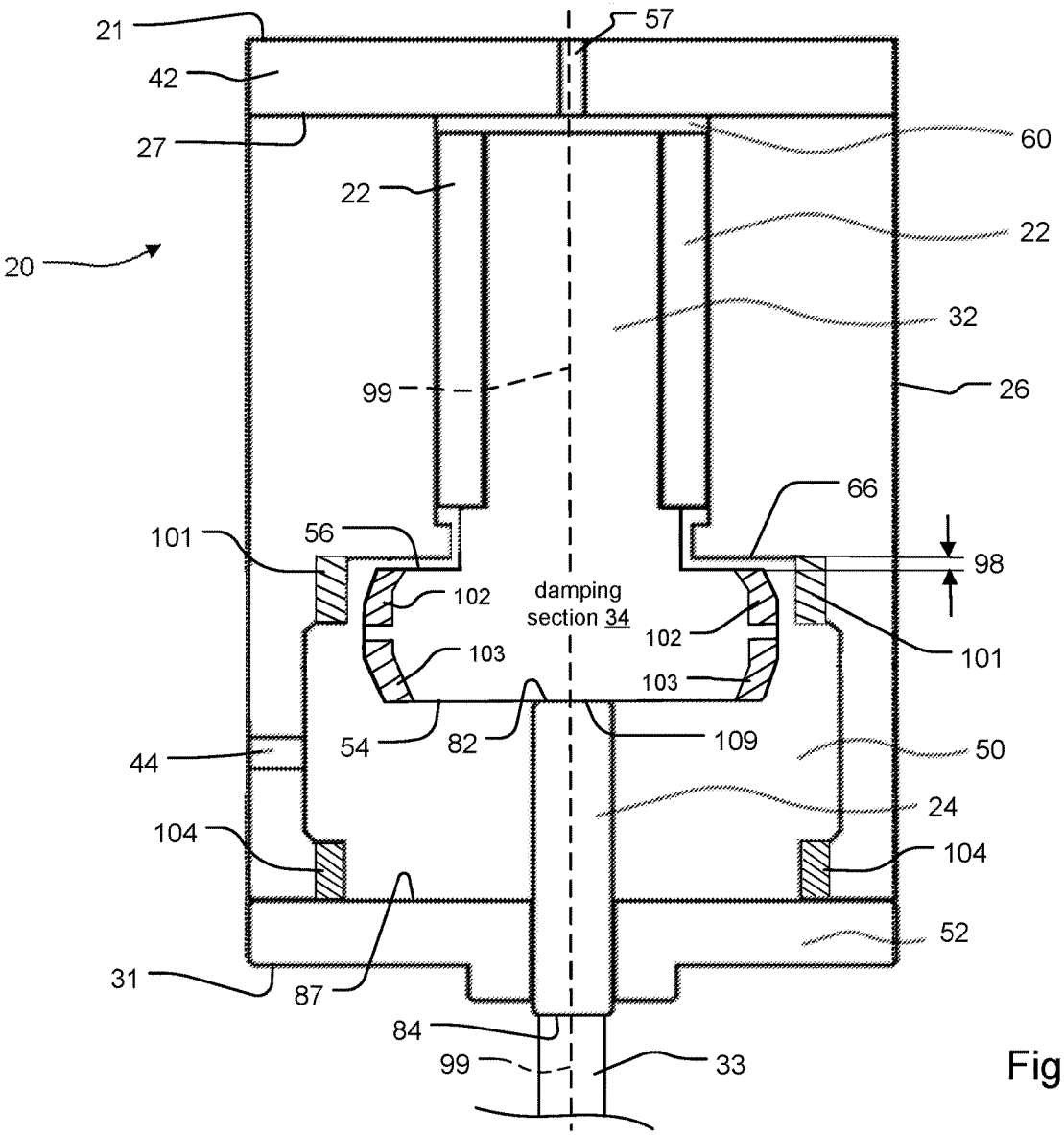
FIG. 4 is a cutaway view of the actuator in the system of FIG. 1 and shows more detail for the actuator.

FIG. 4 shows more detail for the actuator 20, shown in cross-section. In the illustrated example, the actuator 20 is in a closed position. When the actuator cycle of the actuator is timed to an engine cycle of an ICE 70, the actuator is in its closed position when the engine 70 is at the beginning of each engine cycle.

Also at the beginning of the engine cycle, the head 35 of the engine valve 30 is in its seated position/is seated within the valve seat 38 of the engine cylinder 74. Because the drive piston 10 and the adjustment pin 24 are configured to move within the actuating chamber 60 and the damping chamber 50 to drive the engine valve 10, the combination of the drive piston 10 and the adjustment pin 24 are also known as a drive assembly.

Only a portion of the stem 33 of the engine valve 30 is shown. The adjustment pin 24 is designed to be in mating contact with both the drive piston 10 and the engine valve 30. The adjustment pin 24 is arranged vertically and is substantially centered with respect to the travel axis 99.

The boost piston 22 and the top section 32 of the drive piston 10 are seated within the actuating chamber 60. The damping section 34 is seated and designed to travel within the damping chamber 50. The top section 32 is guided through the actuating chamber 60 along the travel axis 99 during operation of the actuator 20.

The surfaces 101, 104 of the damping chamber 50 and the surfaces 102, 103 of the damping section 34 of the drive piston 10 are arranged relative to one another as follows. At the beginning of the engine cycle, the actuator 20 is in its closed position (as shown). The drive piston 10 is at its top-most position within the actuator 20, and the upper chamber surface 101 of the damping chamber 50 and its corresponding upper damping surface 102 of the damping section 34 directly oppose one another.

Also when the actuator 20 is in its closed position, a slight gap 98 is maintained between the top inside surface 66 of the damping chamber 50 and the top 56 of the damping section 34. The gap 98 is needed to account for thermal expansion of the valve stem 33. Due to a tolerance stack-up, this gap 98 will not be accurately controlled without adjusting the length of the adjustment pin 24.

In a middle of the engine cycle, the drive piston 10 is at its bottom-most position within the actuator 10, and the actuator 20 is fully open. The bottom surface 54 of the damping section 34 is located just above the inside surface 87 of the bottom stop 52, and the lower chamber surface 104 of the damping chamber 50 and its corresponding lower damping surface 103 of the damping section 34 directly oppose one another.

An important aspect of engine valve operation that affects the reliability/durability and noise of the HVA system 100 is how fast the actuators 20 and engine valves 30 are moving as they approach their fully open and fully closed positions. The fully open position of each engine valve 30 is preferably met by a hard stop, meaning the drive piston 10 or the engine valve 30 contacts a mechanical stop where metal-to-metal contact ensures an accurately controlled open position for the engine valve 30. Without such a hard stop, the open position of the engine valve 30 is difficult to control, and cylinder-to-cylinder variability in this open position leads to detrimental cylinder-to-cylinder variability of engine valve closing timing.

In the fully closed position of each engine valve 30, the metal-to-metal contact to limit the motion of the engine valve 30 is even more important because this contact is required for the engine valve 30 to fully seal/seat within the valve seat 38. If the drive piston 10 or the engine valve 30 establish contact with their respective stops at too high a velocity, unacceptable wear of the contact surfaces and/or unacceptably high noise may occur. The HVA system 100, via its actuator 20, controllably reduces the velocity of the drive piston 10 and engine valve 30 prior to impact with their stops.

Operation of the actuator 20 over a full engine cycle/valve actuation cycle (opening and closing) is generally as follows. At the beginning of the cycle, the drive piston 10, the adjustment pin 24 and the stem 33 of the engine valve 30 are in their top-most positions relative to the actuator 20. The head 35 of the engine valve 30 is also seated within the valve seat 38 such that pressure is not able to enter into the engine cylinder 70 within which the engine piston 72 travels.

When the control valve 140 is turned on, hydraulic fluid under pressure enters the fluid port 57. As a result, the top of the boost piston 22 and the drive piston 10 are placed under hydraulic pressure. The boost piston 22 and the drive piston 10, together with the adjustment pin 24, begin to move downward/distally towards the distal end 31 of the actuator 20 along the travel axis 99. The damping section 34 of the drive piston 10 begins to push the adjustment pin 24 downward, which in turn begins to pushes the engine valve 30 into an open position. When in its open position, the engine valve 10 enables a mixture of compressed air and fuel to enter the engine cylinder 74 via the valve seat 38.

When the engine reaches the middle of its cycle, the bottom surface 54 of the damping section 34 impacts a top of the bottom stop 52, the engine valve 30 is in its fully open position, and the valve spring 36 is at maximum compression. At this point in the engine cycle, the control valve 140 is turned off, and hydraulic fluid under pressure no longer enters the fluid port 57 until the beginning of the next engine cycle.

Because the drive piston 10 is not under pressure from the middle of the engine cycle/actuation cycle back to the beginning of the next engine cycle, the force provided by the compressed spring 36 provides an upward force upon the collar 37. In response, the engine valve 30 begins to move upward/move proximally toward the top stop 42. Consequently, the adjustment pin 24 begins to move upward, which in turn causes the drive piston 10 to move upward. This upward/proximal motion continues until the top 56 of the damping section 34 reaches the gap 98. At this point, the actuator 20 and the engine valve 30 have returned to their fully closed positions, and the top surface 56 of the damping section 34 and the top inside surface 66 of the damping chamber 50 do not come into contact with one another/are separated by the gap 98. After this point, the control valve 140 is turned on, which starts the next engine cycle.

Figures 5A, 5B, 5C:
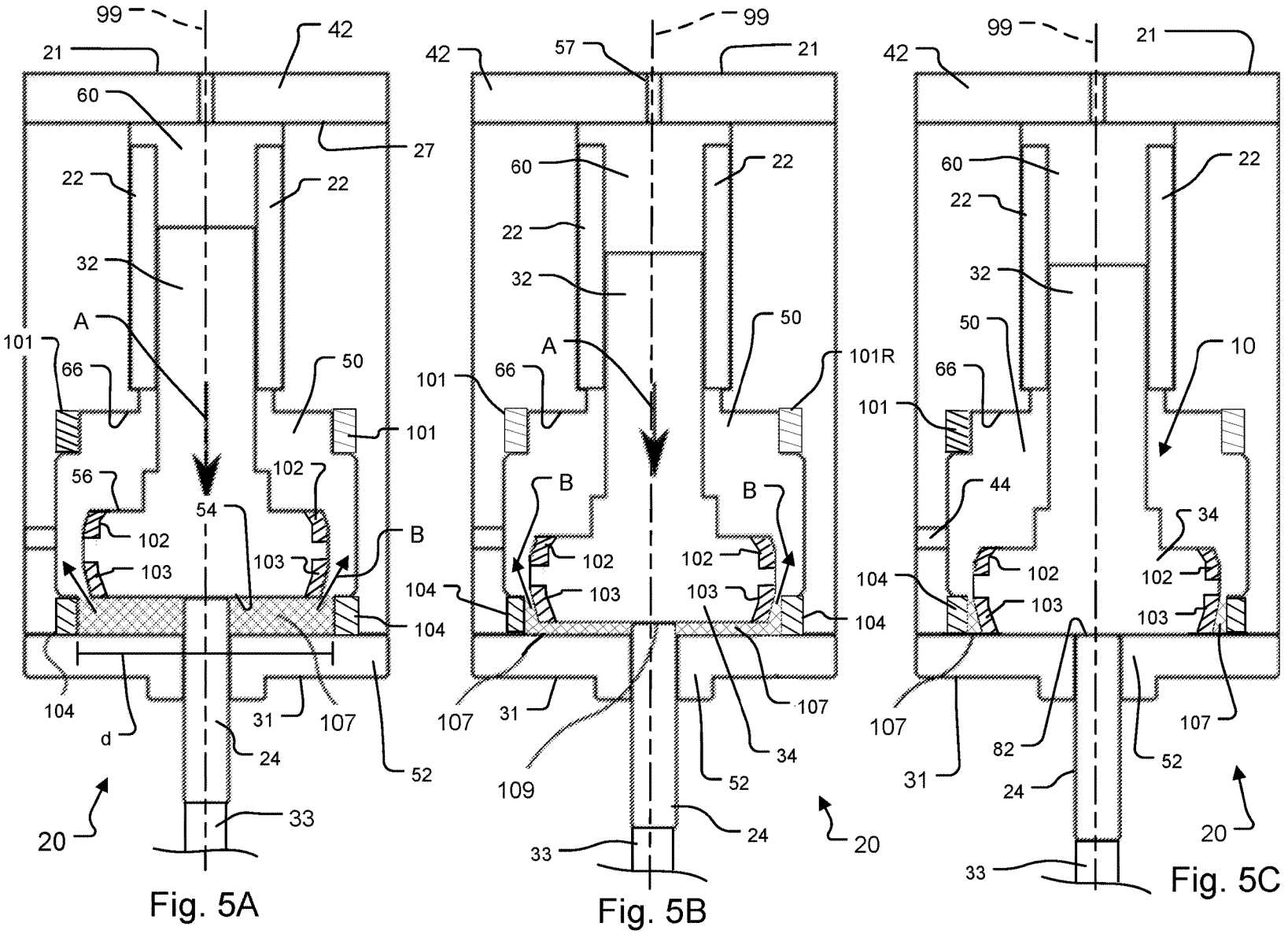
FIG. 5A-5C are cutaway views of the actuator that increasingly illustrate its operation shortly after a beginning of an actuator cycle in FIG. 5A, just before a middle of the cycle in FIG. 5B and at the middle in FIG. 5C.

FIG. 5A-5C illustrate operation of the actuator 20 shortly after the beginning of its actuator cycle and until the middle of the actuator cycle. In the description below, the contributions of the chamber surfaces 101, 104 and the damping surfaces 102, 103 during operation are emphasized.

While the actuator cycle is often tied to/coincides with the engine cycle, it can also be appreciated that the ECU can instruct the hydraulic control valves 140 to open and close their respective actuators 20 independently of the engine cycle. In examples, some engine cylinders 74 are routinely not fired to save energy, and the actuators 20 can be opened and closed to correspondingly open the intake and exhaust engine valves 30 at times more suitable for exhaust gas recirculation (EGR) purposes, or for other situations.

In FIG. 5A, the lower damping surface 103 starts to get squeezed into a 'pocket', or "squeeze pocket" 107 that is defined by a bottom inner diameter "d" of the housing 26 and the top surface 87 of the bottom stop 52. The volume of the squeeze pocket 107 decreases as the drive piston 10 further travels downward/distally in the direction indicated by arrow A, along the travel axis 99 towards the bottom stop 52. Since the entire inner volume of the actuator 20 is filled with hydraulic fluid, this nearly incompressible fluid has to be squeezed out through the annulus formed between the lower damping surface 103 and the lower chamber surface 104.

Arrows B indicate the flow of hydraulic fluid through the annulus. Because the area of the annulus is quite small, the hydraulic fluid can only escape at a sufficient rate if the pressure rises in the squeeze pocket 107. As the area of the annulus decreases, the resultant rising pressure in the squeeze pocket 107 exerts a significant upward/proximally directed force upon the bottom surface 54 of the damping section 34, which will slow down the downward motion of the drive piston 10/decrease its velocity.

In FIG. 5B, the drive piston 10 is still moving downward, but at this position the conical part of the damping surface 103 is already located within the squeeze pocket 107. As a result, the cylindrical part of the damping surface 103 starts to get squeezed into the squeeze pocket 107. The annulus is now tighter/its area is at its smallest value, and the flow area will not change any further.

In FIG. 5C, the drive piston 10 has reached its full travel length, corresponding to a middle of the engine cycle/actuation cycle of the actuator 20. Here, the bottom surface 54 of the damping section 34 is now in contact with the inside surface 87 of the bottom stop 52. Due to the formation of the squeeze pocket 107, the drive piston 10 slows to a very low velocity (typically less than or equal to two tenths of a meter per second) before its bottom surface 54 establishes contact with the inside surface 87 of the bottom stop 52. This is also known as an impact velocity of the drive piston 10/actuator 20. In another example, the impact velocity is less than or equal to 1/10 meters per second. In still another example, the impact velocity is less than or equal to 1 meter per second. The minimized impact velocity provided by the actuator 20 results in a quiet and non-destructive impact of the bottom surface 54 of the damping section 34 upon the inside surface 87 of the bottom stop 52. Such a feature not only reduces engine noise as compared to traditional engines, but also minimizes wear upon the actuator 20, thus extending engine life/improving reliability.

In addition to the minimized impact velocity, the rate at which the drive piston 10 slows down prior to impact is also of importance. One design consideration is that the deceleration should be as rapid as possible so that the engine valve 30 reaches high lift as soon as possible, for better breathing of the engine. At the same time, if the deceleration is too rapid/occurs over too short an interval, the associated momentum will carry on the adjustment pin 24 and the engine valve 30, and the adjustment pin 24 may separate from the drive piston 10 (see FIG. 5B).

Another drawback of drive piston 10 deceleration occurring over too short a time interval is that the adjustment pin 24 will be pushed back with an increased and undesirable force against the drive piston 10 by the valve spring 36. This impact can also generate high noise and component wear. Therefore, any separation between the adjustment pin 24 and the drive piston 10 should altogether be avoided. By carefully selecting the height of the lower chamber surface 104, the height of the conical section on the lower damping surface 103, and the diameters defining the geometry of the resulting annulus, the deceleration can be set to be as fast as possible, while also avoiding separation between the adjustment pin and the drive piston during operation of the actuator, and also providing low seating velocity of the drive piston on the bottom stop.

Figures 6A, 6B, 6C:
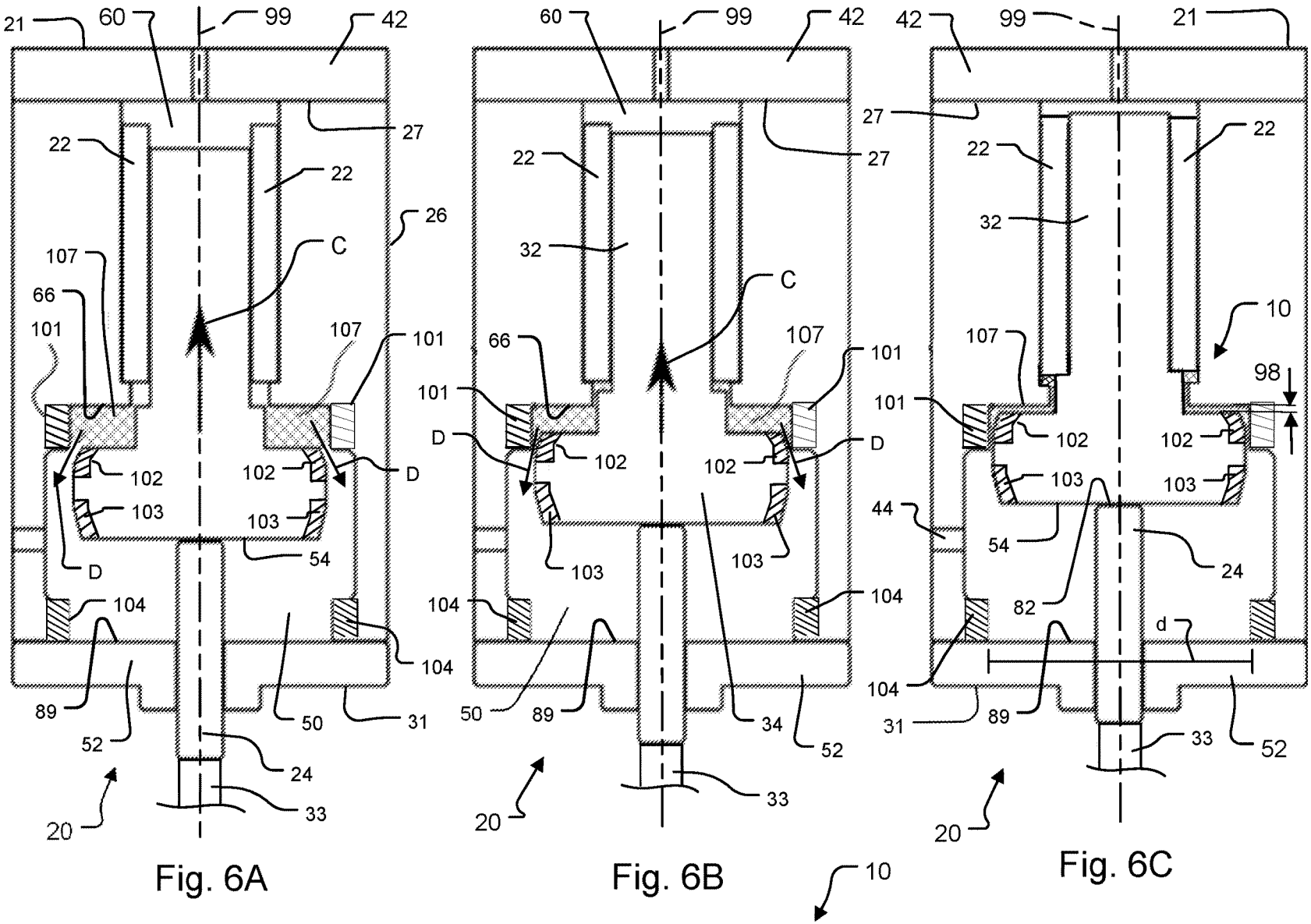
FIG. 6A-6C are cutaway views of the actuator that that increasingly illustrate its operation shortly after the middle of the actuator cycle in FIG. 6A, just before the beginning of the cycle in FIG. 6B and at the beginning in FIG. 6C.

FIG. 6A-6C similarly illustrate the damping mechanism provided by the actuator 20 when the engine valve 30 goes through its closing process/when the engine transitions from the middle of its engine cycle back to its beginning. The engine valve 30 should impact its valve seat 38 at a low velocity, again for noise and wear reduction. Separation between the moving parts this time is not an issue because the part on which the decelerating force is applied (the drive piston 10) is the component that decelerates the rest of the drive assembly. At the same time, the rate at which the engine valve 30 approaches its valve seat 38 can be important. For example, and for reasons not detailed herein, it can be advantageous to keep the engine valve slightly open for a few milliseconds before complete closure.

In FIG. 6A, the actuator 20 is configured for closing of the engine valve 30 in a substantially similar way as that used for the opening of the engine valve in FIG. 5A. Here, the drive assembly moves upward in a direction indicated by arrow C, along the travel axis 99. A squeeze pocket 107 is formed when the drive piston 10 reaches the position as shown in the figure. Here, the upper chamber surface 101 and its corresponding upper damping surface 102 now define the annulus through which the hydraulic fluid will be squeezed out, the direction of which is indicated by arrows D. This generates relatively high pressure in the squeeze pocket 107. The annulus flow area varies with the drive piston 10 position according to the actual shape of the surfaces 101 and 102.

In the illustrated example, in a manner similar to how the lower chamber surface 104 and the lower damping surface 103 are employed during open side damping, the upper damping surface 102 is a cylindrical surface and the upper chamber surface 101 is a combination of a conical and a cylindrical surface. With this setup, the annulus flow area is first larger and later it is smaller.

In FIG. 6B, the drive piston 10 is still moving upward, now at an already reduced velocity, and it is partially squeezed into the squeeze pocket 107 to the point that the constant diameter cylindrical part of the upper damping surface 102 begins to engage with the squeeze pocket 107. The annulus area remains substantially the same as the drive piston 10 moves further upward towards the proximal end 21 of the actuator 20.

FIG. 6C illustrates the position of the actuator 20 and drive assembly (i.e., engine valve 30 is now closed/seated) when the engine cycle is complete and has transitioned back to the beginning of the cycle. As described previously, the height of the squeeze pocket 107, the height of the conical upper chamber surface 101 and the diameters involved can be selected such that optimal closing trajectory of the engine valve 30 is achieved.

More details for the HVA system 100 can be appreciated. The annulus is formed by a female part (here, the chamber surfaces 101 and 104) having a cylindrical surface, and a male part (here, the damping surfaces 102 and 103) having a combination of a cylindrical and a conical surface. Also, the height of the conical surface is less than the height of the pocket into which the conical surface is squeezed. This is true for both the damping provided during opening of the actuator 20 and the damping provided during closing of the actuator 20. However, the surfaces 101/102 and 103/104 that define the annulus can be manufactured to other dimensions and other shapes as well.

The optimum choice for the shape and dimensions of these surfaces 101/102 and 103/104 depends on a number of factors such as the size of the HVA system 100 and its actuators 20, the engine operating speed range, a typical cylinder pressure range, and the like. Most importantly, these surfaces 101/102 and 103/104 are configured to provide an annulus in which the flow area varies as the drive piston 10 and engine valve 30 approach a hard stop to provide an optimum slow-down trajectory for the parts of the drive assembly.

The HVA system 100 might also be configured with or without use of the boost piston 22. The use of the boost piston 22 is typically advantageous, but it is not required.

Figure 7:
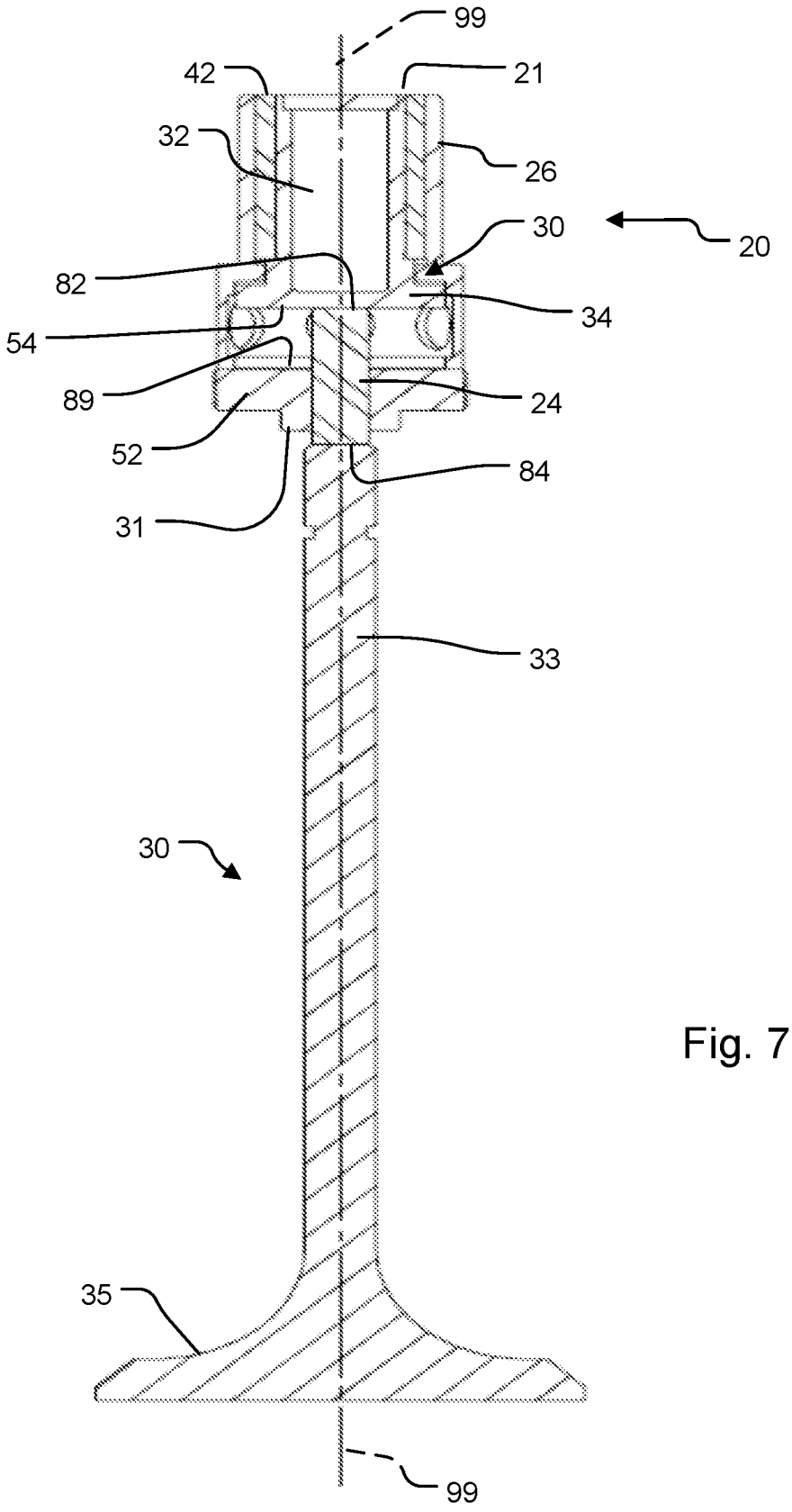
FIG. 7 is a cutaway view of an actuator and an engine valve, where an adjustment pin of the actuator is shown in unattached contact with the engine valve.

FIG. 7 shows an actuator 20, an adjustment pin 24 in contact with the actuator 20 and an engine valve 30. The adjustment pin 24 is in unattached contact with the drive piston 10 of the actuator 20. Specifically, the top surface 82 of the adjustment pin 24 contacts the bottom surface 54 of the damping section 34. The bottom surface 84 of the adjustment pin 24, in turn, connects to the top of the stem 33 of the engine valve 30. The collar 37 of the valve stem 33 is not shown in the figure.

Figure 8:
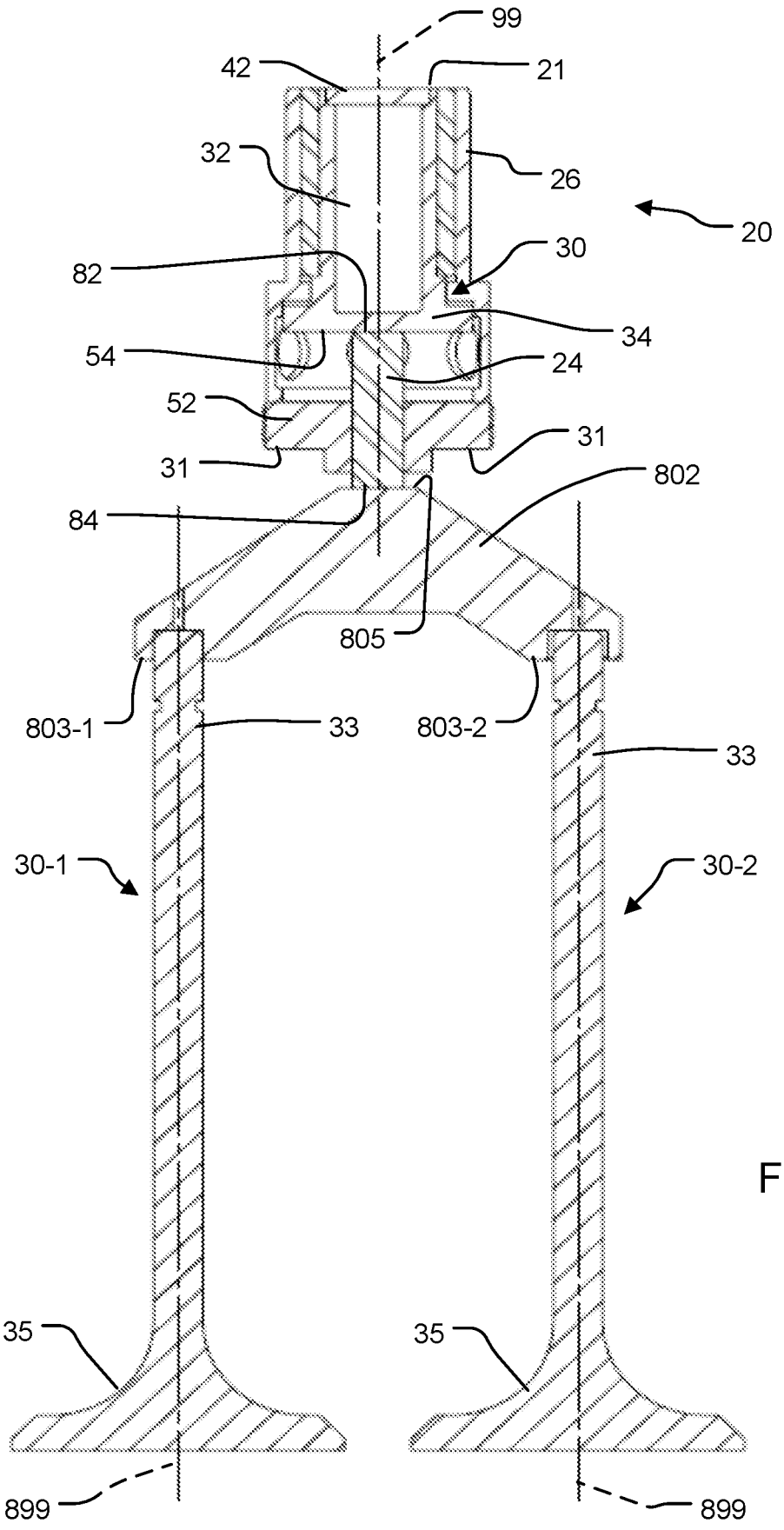
FIG. 8 is a cutaway view of an actuator, two engine valves and a bridge, where the adjustment pin of the actuator is shown in unattached contact with the bridge, and the bridge is connected to the two engine valves.

FIG. 8 shows an actuator 20, an adjustment pin 24 in contact with the actuator 20 and an engine valve 30 as in FIG. 7. However, a bridge 802 is inserted between the bottom surface 84 of the adjustment pin 24 and the top of the stem 33. The bridge 802 is shaped somewhat similar to an upside-down letter "U" and has a flat top surface 805 and two flat bottom surfaces 803-1 and 803-2. In one embodiment, as shown, the two flat bottom surfaces 803-1 and 803-2 are recessed within a body of the bridge 802.

In more detail, the top surface 805 of the bridge 802 is attached to the bottom surface 84 of the adjustment pin 24. The bottom surfaces 803-1, and 803-2 of the bridge 802, in turn, connect to two engine valves 30-1 and 30-2, respectfully. In this way, when the actuator 20 is in its open position (such as when an ICE 70 is in the middle of its engine cycle), the actuator 20, via the bridge 802, can push/move the two engine valves 30-1, 30-2 simultaneously.

The actuator 20 is designed so that the top surface 82 of the adjustment pin 24 is and remains in unattached contact with the bottom surface 54 of the damping section 34 at all times during each actuation cycle of the actuator 20. This is a result of the velocity damping of the drive position 10, enabled by the chamber surfaces 101, 104 and the damping surfaces 102, 103 and the annulus that the surfaces provide or otherwise form during operation of the actuator 20. The gradual reduction in the velocity of the drive piston 10 assures that the drive piston 10, the adjustment pin 24, engine valve 30, and optionally the bridge 802 and its engine valves 30-1, 30-2 do not mechanically separate in a spring return-based HVA system 100 as in FIG. 1.

Figure 9:
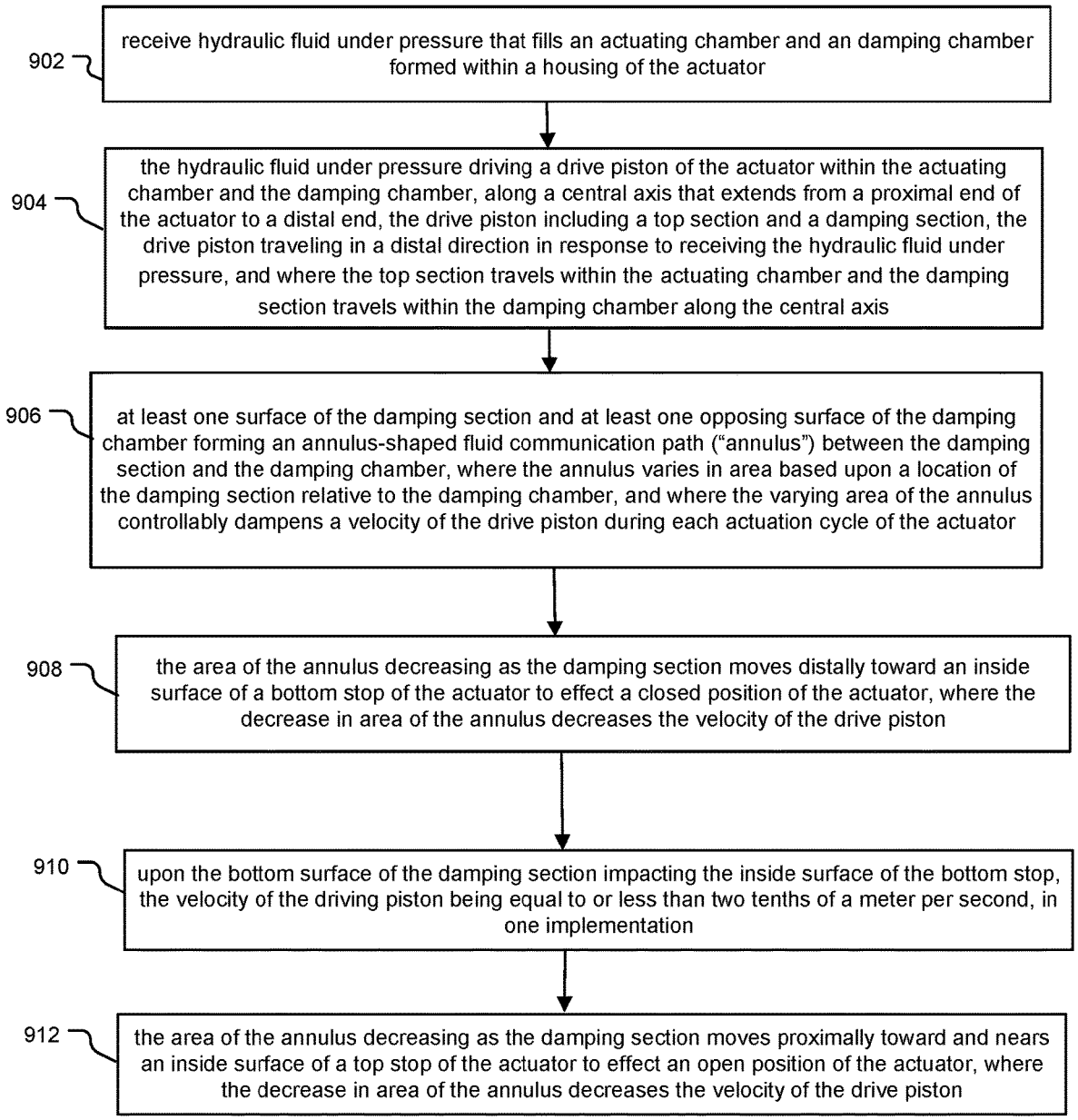
FIG. 9 is a flowchart that describes a method of operation of the actuator.

FIG. 9 is a flowchart that describes a method of operation of the HVA system 100. The method starts at step 902.

In step 902, the actuator 20 receives hydraulic fluid under pressure that fills the actuating chamber 60 and the damping chamber 50. According to step 904, the hydraulic fluid provides fluid pressure upon the drive piston 10 to drive the drive piston 10 within the actuating chamber 60 and the damping chamber 50 along the central axis 99, the latter of which extends from the proximal end 21 to the distal end 31 of the actuator 20. The drive piston 10 includes a top section 32 and a damping section 34. The drive piston 10 travels in a distal direction in response to receiving the hydraulic fluid under pressure. The top section 32 travels within the actuating chamber 60 and the damping section 34 travels within the damping chamber 50 along the central axis 99.

In step 906, at least one surface 102, 103 of the damping section 34 and at least one opposing surface 101, 104 of the damping chamber 50 form an annulus-shaped fluid communication path ("annulus") between the damping section 34 and the damping chamber 50, where the annulus varies in area based upon a location of the damping section 34 relative to the damping chamber 50. Here, the varying area of the annulus controllably dampens a velocity of the drive piston 10 within the damping chamber 50 during each actuation cycle of the actuator 20.

In step 908, the area of the annulus decreases as the damping section 34 moves distally toward the inside surface 87 of the bottom stop 52 to effect a closed position of the actuator 20, where the decrease in area of the annulus decreases the velocity of the drive piston 10. In this example, the lower chamber surface 104 and its corresponding lower damping surface 103 of the drive piston 10 typically define the annulus.

Then, in step 910, upon the bottom surface 54 of the damping section 34 impacting the inside surface 87 of the bottom stop 52, in one implementation, the velocity of the drive piston 10 is equal to or less than two tenths of a meter per second. In this example, the lower chamber surface 104 and its corresponding lower damping surface 103 of the drive piston 10 typically define the annulus.

Finally, in step 912, the area of the annulus decreases as the damping section 34 moves proximally toward and nears the inside surface 27 of the top stop 42 to effect an open position of the actuator 20, where the decrease in area of the annulus decreases the velocity of the drive piston 10. In this example, the upper chamber surface 101 and its corresponding upper damping surface 102 of the drive piston 10 typically define the annulus.

The fuel and hydraulic fluid pressures specified in this disclosure are typical, but they can be higher or lower in a specific implementation of the HVA system 100. It can also be appreciated that the principles of the HVA system 100 can be applied to any hydraulic actuator application when a need for the drive piston 10 of the actuator 20 to approach its extreme positions at low and controlled velocity is desirable.

While the proposed HVA system 100 is preferably tailored to provide control of engine valves in ICEs, it can also be appreciated that the HVA system and its components have other industrial applications. In examples, the actuator 20 might be connected to a hydraulic system and configured to control robotic arms and conveyor systems in a manufacturing facility, and one or more components of machine presses and computer numerical control (CNC) machining systems. In other examples, the actuator 20 might be deployed within a vehicle such as an airplane or automobile and connected to its hydraulic system. The actuator 20 might also be configured to control operation of ailerons and flaps in airplanes, and components in braking and regenerative systems in vehicles such as ICE-only vehicles, hybrid ICE/electric and electric-only vehicles, in examples.

It can also be appreciated that instead of using the valve spring 36 to return the engine valve 30 and the actuator drive pistons 10 to their initial positions, hydraulic pistons might also be used for this purpose. In this way, the hydraulic pistons enable the actuator 20 to be used in applications other than ICEs 70.

While this invention has been particularly shown and described with references to preferred embodiments thereof, it will be understood by those skilled in the art that various changes in form and details may be made therein without departing from the scope of the invention encompassed by the appended claims.

What is claimed is:

1. A hydraulic actuator, comprising:

a cylindrical housing including:

a top stop, a bottom stop, an actuating chamber defined by the housing and an inside surface of the top stop so as to extend along a central axis of the housing, and a damping chamber defined by the housing and an inside surface of the bottom stop so as to extend along the central axis; and a hydraulically-actuated drive piston including:

a top section formed at a first end of the drive piston, the top section configured to reciprocate within the actuating chamber along the central axis, and a damping section formed at a second end of the drive piston opposite the first end, the damping section configured to reciprocate within the damping chamber along the central axis;

wherein an annulus consisting of an annular fluid communication path is formed between at least one surface of the damping section and at least one surface of the damping chamber such that an area of the annulus varies based on a location of the damping section relative to the damping chamber so as to controllably dampen a velocity of the drive piston during each actuation cycle of the actuator, wherein a diameter of the damping section is greater than a diameter of the top section, wherein a diameter of the damping chamber is greater than a diameter of the actuating chamber so as to accommodate the damping section, and wherein the drive piston is included entirely within the housing such that, during operation of the drive piston, the damping section remains in the damping chamber, and the top section is at least partially disposed in the actuating chamber.

2. The actuator of claim 1, wherein the annulus is formed between at least one lower surface of the damping section and at least one lower surface of the damping chamber such that the area of the annulus decreases as the damping section approaches the inside surface of the bottom stop so as to dampen the velocity of the drive piston.

3. The actuator of claim 1, wherein the velocity of the drive piston is less than or equal to 0.2 m/s when the damping section impacts the inside surface of the bottom stop.

4. The actuator of claim 1, further comprising an adjustment pin including a top surface configured to remain in unattached contact with a bottom surface of the damping section throughout each actuation cycle of the actuator.

5. The actuator of claim 4, wherein the adjustment pin further includes a bottom surface configured to be attached to an engine valve so as to control opening and closing of the engine valve.

6. The actuator of claim 4, wherein a bottom surface of the adjustment pin engages a bridge configured to control opening and closing of at least two engine valves.

7. The actuator of claim 1, wherein the annulus is formed between at least one upper surface of the damping section and at least one upper surface of the damping chamber such that the area of the annulus decreases as the damping section approaches a top inside surface of the damping chamber so as to dampen the velocity of the drive piston.

8. The actuator of claim 1, wherein the damping section is disk-shaped, and wherein the at least one surface of the damping section is a conical surface.

9. The actuator of claim 1, wherein the at least one surface of the damping chamber is a cylindrical surface.

10. A method of operating the hydraulic actuator of claim 1, the method comprising:

receiving a flow of pressurized hydraulic fluid within the actuating chamber via the top stop so as to drive the top section of the driving piston towards the damping chamber;

biasing the damping section towards a top inside surface of the damping chamber when the flow of pressurized hydraulic fluid is stopped;

varying the area of the annulus based on the location of the damping section relative to the damping chamber so as to controllably dampen the velocity of the drive piston during each actuation cycle of the actuator; and dampening the velocity of the drive piston via the annulus as the damping section alternately approaches the inside surface of the bottom stop and the top inside surface of the damping chamber.

11. The method of claim 10, wherein the area of the annulus decreases as the damping section approaches the inside surface of the bottom stop so as to dampen the velocity of the drive piston.

12. The method of claim 10, wherein the velocity of the drive piston is less than or equal to 0.2 m/s when the damping section impacts the inside surface of the bottom stop.

13. The method of claim 10, wherein the hydraulic actuator further comprises an adjustment pin including a top surface configured to remain in unattached contact with a bottom surface of the damping section throughout each actuation cycle of the actuator.

14. The method of claim 13, wherein the adjustment pin further includes a bottom surface configured to be attached to an engine valve so as to control opening and closing of the engine valve.

15. The method of claim 13, wherein a bottom surface of the adjustment pin engages a bridge configured to control opening and closing of at least two engine valves.

16. The method of claim 10, wherein the area of the annulus decreases as the damping section approaches the top inside surface of the damping chamber so as to dampen the velocity of the drive piston.

17. A hydraulic valve actuation (HVA) system, comprising:

a hydraulic actuator including:

a cylindrical housing including:

a top stop, a bottom stop, an actuating chamber defined by the housing and an inside surface of the top stop so as to extend along a central axis of the housing, and a damping chamber defined by the housing and an inside surface of the bottom stop so as to extend along the central axis;

a hydraulically-actuated drive piston including:

a top section formed at a first end of the drive piston, the top section configured to reciprocate within the actuating chamber along the central axis, and a damping section formed at a second end of the drive piston opposite the first end, the damping section configured to reciprocate within the damping chamber along the central axis;

an adjustment pin including a top surface configured to remain in unattached contact with a bottom surface of the damping section throughout each actuation cycle of the actuator; and at least one engine valve configured to be driven via movement of the adjustment pin;

wherein the damping chamber is configured to receive pressurized hydraulic fluid, wherein an annulus consisting of an annular fluid communication path is formed between at least one surface of the damping section and at least one surface of the damping chamber such that an area of the annulus varies based on a location of the damping section relative to the damping chamber, wherein the annulus is configured to dampen a velocity of the drive piston as the damping section alternately approaches the inside surface of the bottom stop and a top inside surface of the damping chamber, wherein a diameter of the damping section is greater than a diameter of the top section, wherein a diameter of the damping chamber is greater than a diameter of the actuating chamber so as to accommodate the damping section, and wherein the drive piston is included entirely within the housing such that, during operation of the drive piston, the damping section remains in the damping chamber, and the top section is at least partially disposed in the actuating chamber.

18. The HVA system of claim 17, wherein the at least one engine valve includes a first engine valve and a second engine valve each attached to a bottom of a bridge, and wherein a top of the bridge is attached to a bottom surface of the adjustment pin so as to control operation of the first and second engine valves in response to the movement of the adjustment pin.

19. The HVA system of claim 17, wherein the damping section is disk-shaped, and wherein the at least one surface of the damping section is a conical surface.

20. The HVA system of claim 17, wherein the at least one surface of the damping chamber is a cylindrical surface.

* * * * *